US009017185B2

(12) United States Patent
Ashino

(10) Patent No.: US 9,017,185 B2
(45) Date of Patent: Apr. 28, 2015

(54) GOLF CLUB SET

(75) Inventor: Takeshi Ashino, Kobe (JP)

(73) Assignee: Dunlop Sports Co., Ltd., Kobe (JP)

( * ) Notice: Subject to any disclaimer, the term of this patent is extended or adjusted under 35 U.S.C. 154(b) by 183 days.

(21) Appl. No.: 13/571,942

(22) Filed: Aug. 10, 2012

(65) Prior Publication Data

US 2013/0040752 A1 Feb. 14, 2013

(30) Foreign Application Priority Data

Aug. 12, 2011 (JP) ..... 2011-177069

(51) Int. Cl.

*A63B 53/04* (2006.01)
*A63B 53/00* (2006.01)
*A63B 53/10* (2006.01)

(52) U.S. Cl.

CPC ..... *A63B 53/00* (2013.01); *A63B 53/10* (2013.01); *A63B 2053/005* (2013.01); *A63B 2053/042* (2013.01); *A63B 2053/0462* (2013.01); *A63B 2053/0416* (2013.01); *A63B 2053/0458* (2013.01); *A63B 2053/0454* (2013.01); *A63B 53/0466* (2013.01); *A63B 2053/0408* (2013.01)

(58) Field of Classification Search

CPC .... A63B 53/00; A63B 53/10; A63B 53/0466; A63B 2053/005; A63B 2053/042; A63B 2053/0462; A63B 2053/0416; A63B 2053/0458; A63B 2053/0454; A63B 2053/0408

USPC ..... 473/290–291, 346

See application file for complete search history.

(56) References Cited

U.S. PATENT DOCUMENTS

| | | | | |
|---|---|---|---|---|
| 6,723,005 | B2 * | 4/2004 | Hueber | 473/291 |
| 6,966,848 | B2 * | 11/2005 | Kusumoto | 473/342 |
| 7,220,190 | B2 * | 5/2007 | Hirano | 473/342 |
| 7,618,331 | B2 * | 11/2009 | Hirano | 473/329 |

FOREIGN PATENT DOCUMENTS

| | | | |
|---|---|---|---|
| JP | 2003-24476 | A | 1/2003 |
| JP | 2006-197979 | A | 8/2006 |

* cited by examiner

*Primary Examiner* — Stephen Blau
(74) *Attorney, Agent, or Firm* — Birch, Stewart, Kolasch & Birch, LLP

(57) ABSTRACT

A golf club set comprises golf clubs with different club lengths, each golf club comprising a hollow golf club head, the golf club head with a face portion having a clubface for hitting a ball, the face portion comprising a central thicker portion, a toe-side thinner portion with a thickness smaller than that of the central thicker portion, and a heel-side thinner portion with a thickness smaller than that of the central thicker portion, wherein in a front view of the club head under a standard state, the toe-side thinner portion is provided so that a centroid thereof is placed upward than a center of the clubface, the heel-side thinner portion is provided so that a centroid thereof is placed downward than the center of the clubface.

16 Claims, 8 Drawing Sheets

GOLF CLUB SET

BACKGROUND OF THE INVENTION

1. Field of the Invention

The present invention relates to a golf club set with the different club lengths, more particularly to a golf club set to suppress the deterioration of the resilience performance of the face portion at the time of miss shots by setting a thickness distribution of the face portion in consideration of the club length.

2. Description of the Related Art

A golf club set comprises a plurality of golf clubs with the different loft angles and club lengths as a group, for example, a wood-type golf club set, and a utility-type golf club set have been proposed. Usually, golf clubs in a golf club set have the same brands, the same product names and/or the same designs to be given a sense of unity in the set. However, these clubs in the set may be sold not only as a set but also as each one.

It is an object of the present invention to provide a golf club set to suppress the deterioration of the resilience performance of the face portion at the time of miss shots.

SUMMARY OF THE INVENTION

In accordance with the present invention, there is provided a golf club set comprising a plurality of golf clubs each with the different club length, each golf club comprising a clubshaft and a hollow golf club head attached to an one end of the clubshaft, the golf club head having a face portion whose front face defines a clubface for hitting a ball, the face portion comprising a central thicker portion provided in a center region thereof, a toe-side thinner portion provided in a toe side of the face portion and having a thickness smaller than that of the central thicker portion, and a heel-side thinner portion provided in a heel side of the face portion and having a thickness smaller than that of the central thicker portion, wherein in a front view of the club head under a standard state that the golf club head is placed on a horizontal plane, so that the center line of the clubshaft inclines at its lie angle within a vertical plane, and the clubface inclines at its loft angle with respect to the vertical plane, the toe-side thinner portion is provided so that a centroid thereof is placed upward than a center of the clubface, the heel-side thinner portion is provided so that a centroid thereof is placed downward than the center of the clubface, and as for an angle θA of a first straight line passing through the center of the clubface and the centroid of the toe-side thinner portion with respect to the horizontal plane, and an angle θB of a second straight line passing through the center of the clubface and the centroid of the heel-side thinner portion with respect to the horizontal plane, the longer the club length is, the larger the angles of θA and θB are.

DETAILED DESCRIPTION

An embodiment of the present invention will be explained below with reference to the accompanying drawings.

Figure 1:
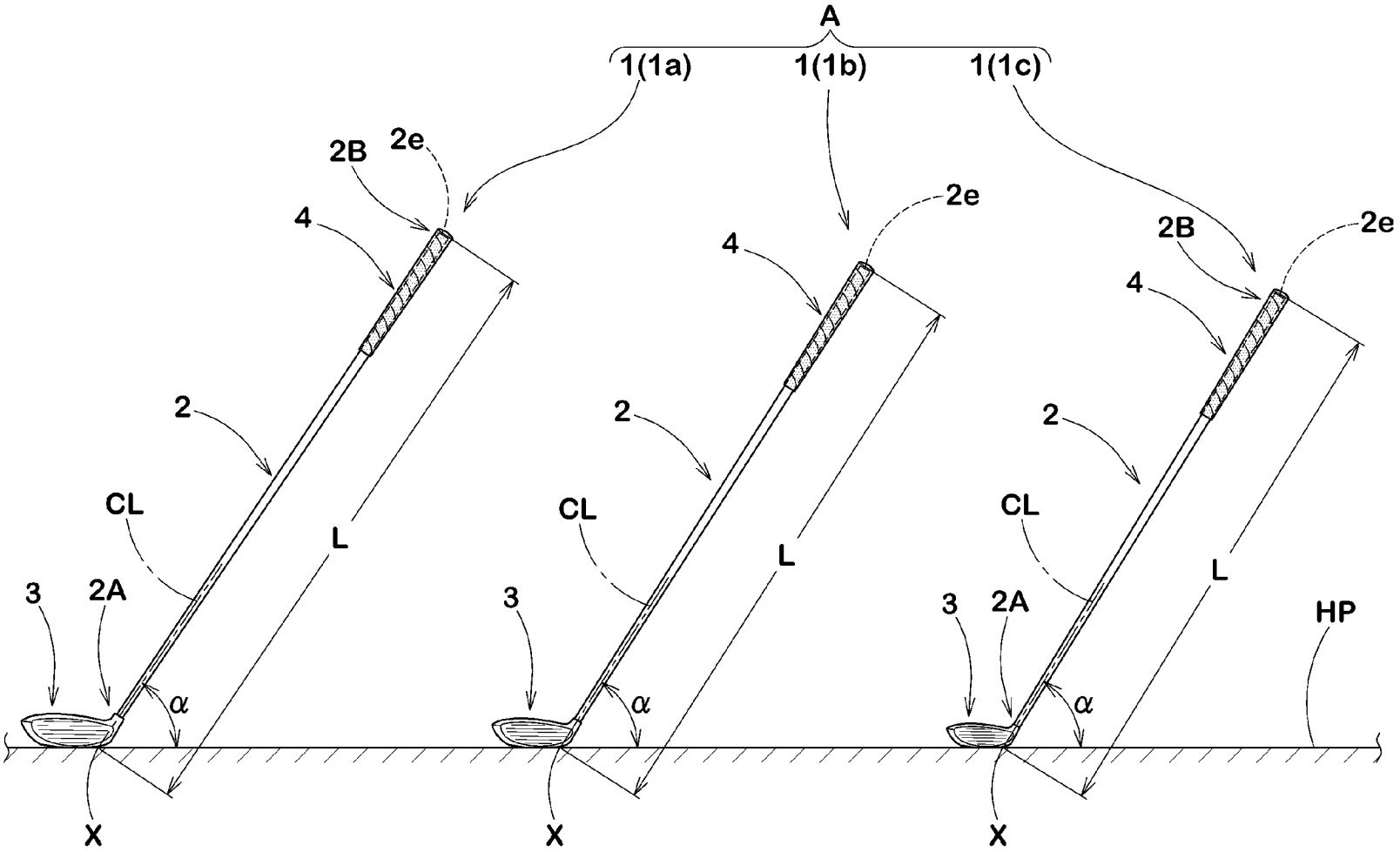
FIG. 1 is a front view of golf clubs under a standard state included in a golf club set showing an embodiment of the present invention.
Figure 2A:
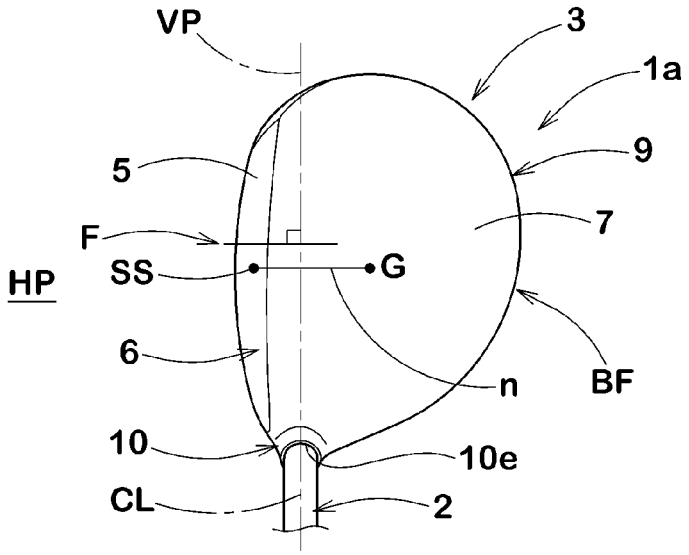
FIGS. 2*a* to 2*c* are plan views of each club head of FIG. 1.
Figure 2B:
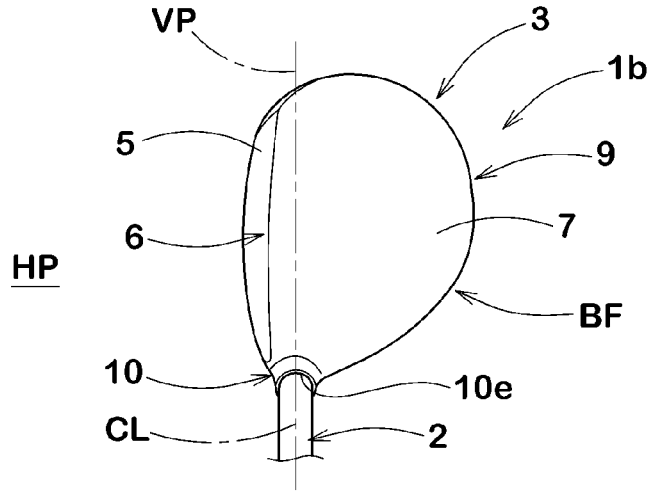
Figure 2C:
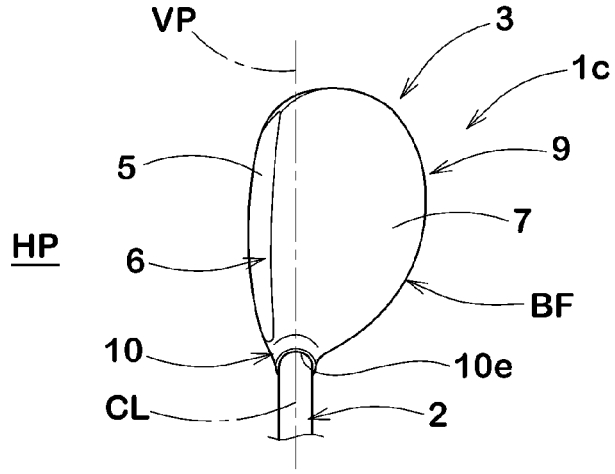

As shown in FIGS. 1 to 2, a golf club set (hereinafter referred simply as "set") (A) according to an embodiment of the present invention comprises a plurality of golf clubs (hereinafter referred simply as "golf club") 1 with different club lengths L. The set (A) in this embodiment comprises three wood-type golf clubs which consist of a three wood (#3) club 1*a*, a five wood (#5) club 1*b* and a seven wood (#7) club 1*c*.

Here, a golf club set (A) shall mean a group of golf clubs which have the same brands, the same product names and the same basic design. Usually, these golf clubs in a set may be sold not only as a set but also as each one club.

Also, a golf club shall means a wood-type golf club which has a wood-type golf club head that was originally made of wood, and an utility-type golf club with a specialized wood-type head which is different from a wood-type head in number or name, but has a shape approximately similar to the wood-type head. Therefore, the set (A) according to the present embodiment comprises the following combinations of golf clubs:

(a) a plurality of fairway wood golf clubs;

(b) a plurality of utility-type golf clubs;

(c) golf clubs of the group (a), and a driver (#1);

(d) golf clubs of the groups (a) and (b); and (e) golf clubs of the group (d), and a driver (#1).

Although it is not particularly limited, the number of the golf clubs 1 in the set (A) is preferably not less than three, and preferably not more than ten. These golf clubs 1 in the set (A), for example, have the same brands, the same product names and the same basic design so as to be given a sense of unity in the set.

Each golf club 1 comprises a clubshaft 2, a golf club head (hereinafter referred simply as "head") 3 attached to one end 2A of the clubshaft 2, and a grip 4 attached to the other end 2B of the clubshaft 2.

Although the club length L is not particularly limited, the length L is preferably set not less than 35.0 inches, more preferably not less than 36.0 inches, and preferably set not more than 46.0 inches, and more preferably not more than 45.0 inches. These golf clubs with such club lengths provide a good swing balance and a high swing speed based on the length for golfers.

Here, the standard state is a state that the golf club 1 is placed on a horizontal plane HP, so that a clubshaft center line CL inclines at its lie angle α within a vertical plane VP, and a center SG of the clubface 5 inclines at its loft angle with respect to the vertical plane VP. The Golf club 1 referred to herein is in the standard state unless otherwise noted.

In the standard state, the face angle of the clubface 5 is set at zero degree. Also, the loft angle is defined more than 0 degree, and is defined as an angle of a tangent line passing through the center SG of the clubface 5 with respect to the vertical plane VP.

The club length L shall mean a length measured along the clubshaft centerline CL from the end 2*e* of the clubshaft 2 at the grip side to an intersecting point x between the centerline CL and the horizontal plane HP under the standard state, as shown in FIG. 1.

The clubshaft 2 is preferably composed of fiber reinforced plastic. Such a clubshaft 2 has an advantage to make it easier to swing in lightweight, and a high degree of freedom for designing the weight and the bending point, for example. As for the clubshaft 2, a metallic material may be employed.

Figure 3:
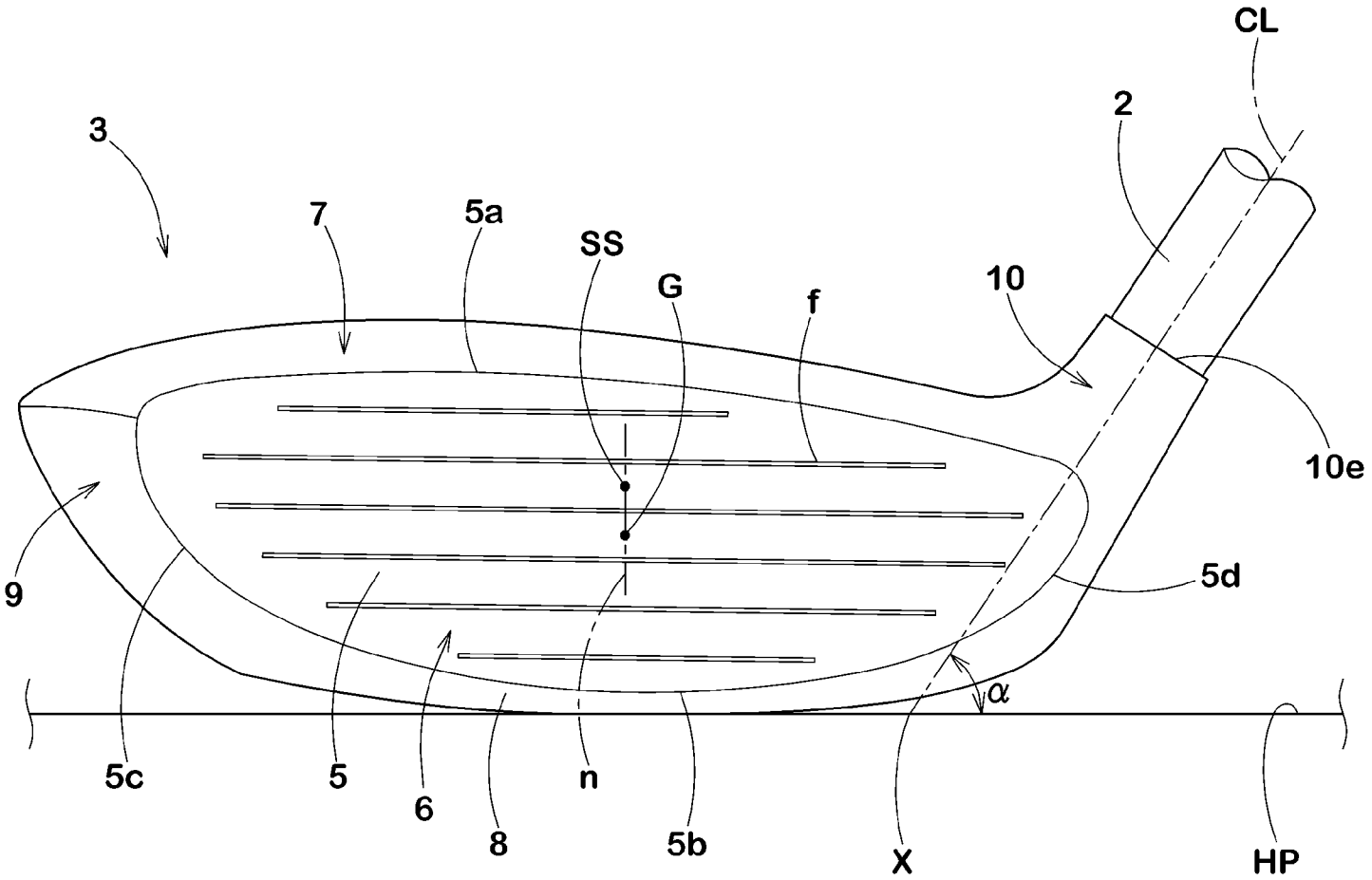
FIG. 3 is a front view of a golf club.
Figure 4:
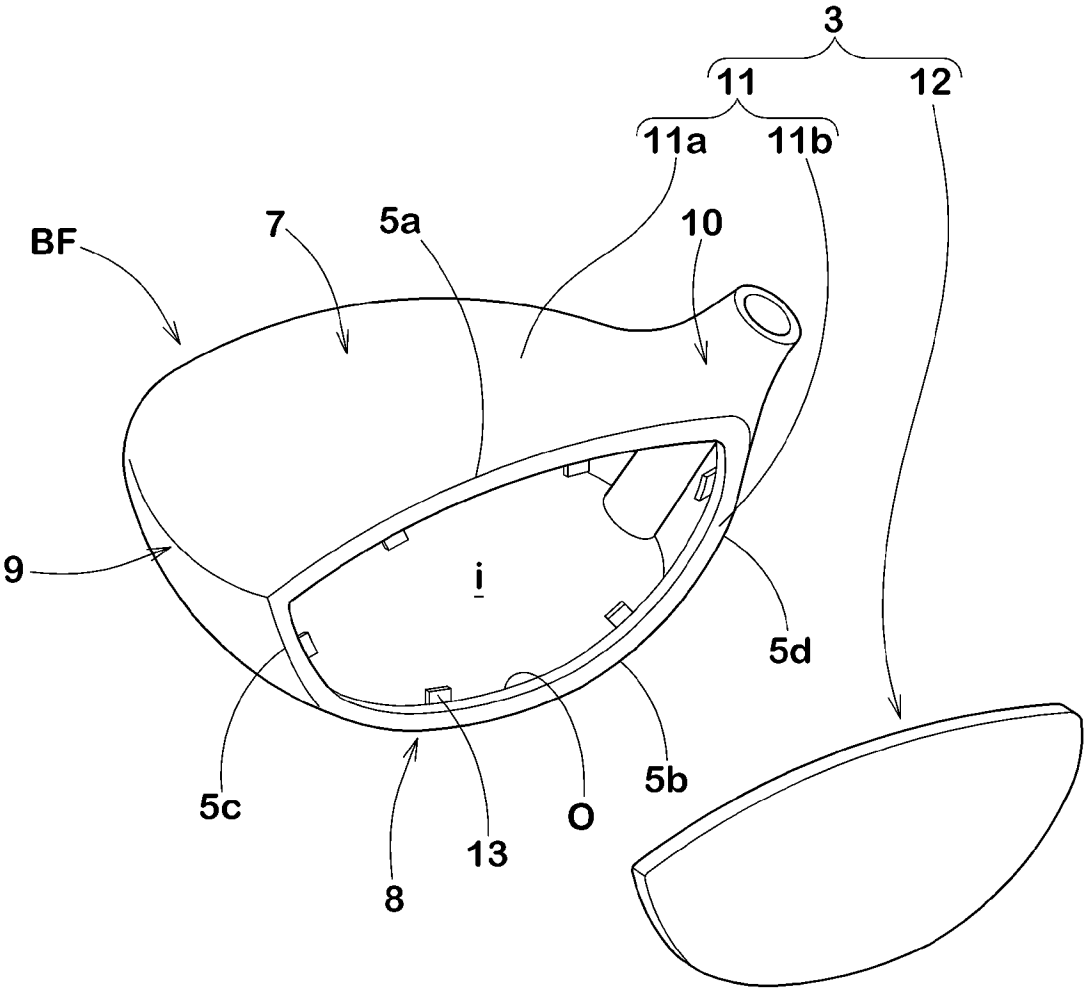
FIG. 4 is an exploded view of a golf club head.

As shown in FIGS. 3 and 4, the club head 3 includes a face portion 6 whose front face defines the clubface 5 for hitting a golf ball, a crown portion 7 extending from an upper edge 5*a* of the clubface 5 to form the upper surface of the head, a sole portion 8 extending from lower edge 5*b* of the clubface 5 to form the bottom surface of the head, a side portion 9 which extends between the crown portion 7 and the sole portion 8 from a toe side edge 5*c* of the clubface 5 to a heel side edge 5*d* of the clubface 5 through a back face BF of the head, and a hosel portion 10 which is disposed on a heel side of the crown portion 7 and has a shaft inserting hole 10*e* to attach the clubshaft 2. The club head 3 according to the present invention is made of metallic material, and has a hollow (i) on the interior thereof.

In this embodiment, the club head 3 comprises a two-piece structure which includes a head main body 11 provided an opening (o) with the face portion 6, and a face member 12 attached to the head main body 11 so as to close the opening (O), as shown in FIG. 4. The head main body 11 preferably has a plurality of support pieces K around the opening (O) to support the face member 1B. As for the structure of the club head 3, three-piece or four-piece structure may be employed.

The head body 11 and the face member 12 are produced from one or more kinds of metallic materials. Preferable examples of the metallic materials are, for instance, a stainless steel, a titanium alloy, and combinations of these metals. Further, although not shown in the drawings, non-metallic materials with a lower specific gravity such as fiber reinforced plastic may be used in a part of the head 3.

The head main body 11 in this embodiment integrally includes the crown portion 7, the sole portion 8, the side portion 9, the hosel portion 10 and a periphery 11*b* of the opening in the face portion 6. The head main body 11 can be produced by a known method, e.g., casting to improve the productivity thereof. Further, the head main body 11 can be produced by forging or pressing to improve the accuracy thereof. Two or more parts can be also employed to form the head main body 1A.

The opening (O) is formed as a shape with an outline within the scope of the clubface 5 surrounded by the edges 5*a* to 5*d*. The outline of the opening (O) has an oval shape along with the edges 5*a* to 5*d* of the clubface 5 and including a sweet spot SS of the clubface 5. Here, as shown in FIG. 3, the sweet spot SS is the point of intersection between the clubface 5 and a straight line (n) drawn normally to the clubface 5 passing the center of gravity G of the head.

The face member 12 in this embodiment is formed into an approximately plate-shape with an outline which fits the opening (O) of the head main body 11 and forms a main part of the clubface 5. The face member 12, for example, is preferably produced by using a precision machining to process a punched piece with a predetermined shape obtained from a rolled material.

Although it is not especially limited, the club head 3 preferably has a head volume of at least 100 $cm^3$, more preferably at least 135 $cm^3$. If the volume of the club head 3 is too small, problems may arise, e.g., the sweet area of the clubface tends to be smaller, and the resilience performance thereof tends to deteriorated at miss shot. On the other hand, the range of the volume of the club head 1 is limited by Golf rules. Therefore, it is preferable that the volume of club head 3 is preferably at most 460 $cm^3$.

Further, it is preferable that the whole weight of club head 3 is at least 180 g, especially at least 185 g, and it is at most 300 g, especially at most 290 g. If the weight is too small, the kinetic energy tends to lower, and then the flight distance of a hit ball tends to deteriorate. If the weight of the club head 3 is too large, it is difficult to follow through a golf club, so the flight distance and directionality of a hit ball tend to deteriorate.

The grip 4 is made of a rubber compound which includes, for example, a natural rubber, oil, a carbon black, sulfur and an oxide of zinc. The rubber compound is kneaded, and vulcanized to form the predetermined grip shape. The weight of the grip 4 is preferably set in the range of from 38 to 46 g.

The inventor of the present invention repeated various experiments to suppress a flight distance loss of hit ball at the time of miss shot, and as a result, he found that to change the distribution of thickness of the face portion based on the club length L was effective in the golf club set A.

Figure 8A:
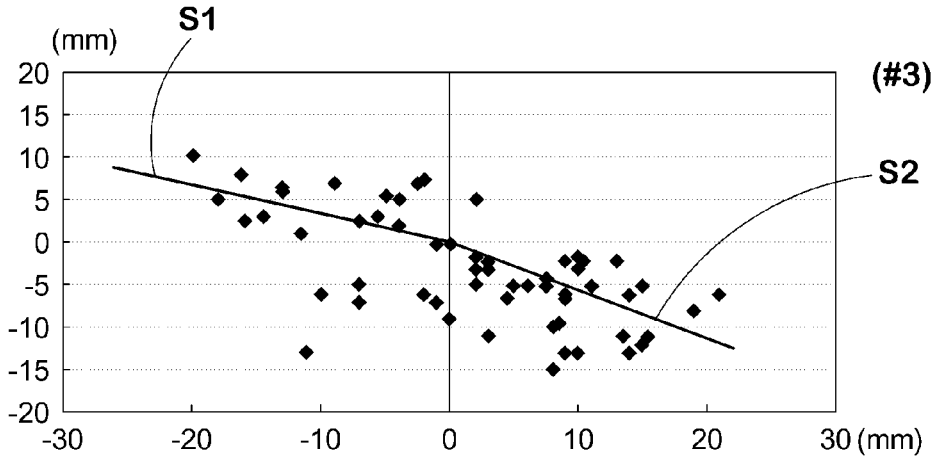
FIGS. 8*a* to 8*c* are graphs showing dispersals of hit points of golf clubs in a golf club set.
Figure 8B:
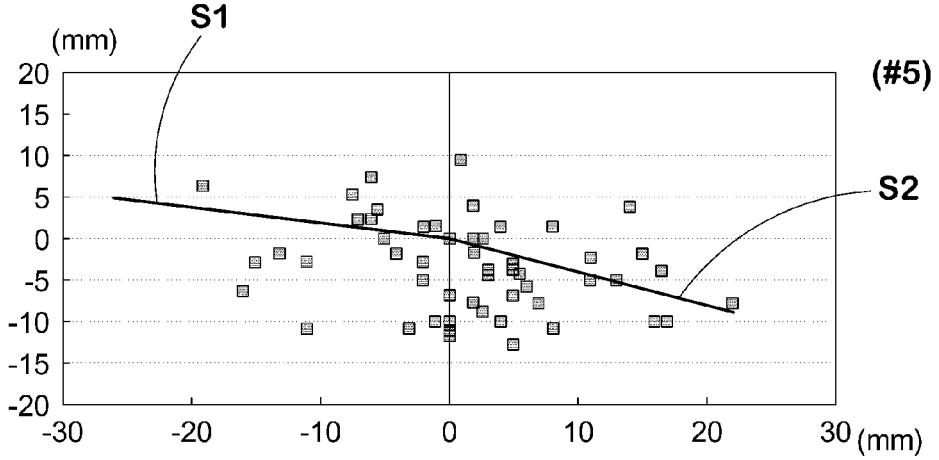
Figure 8C:
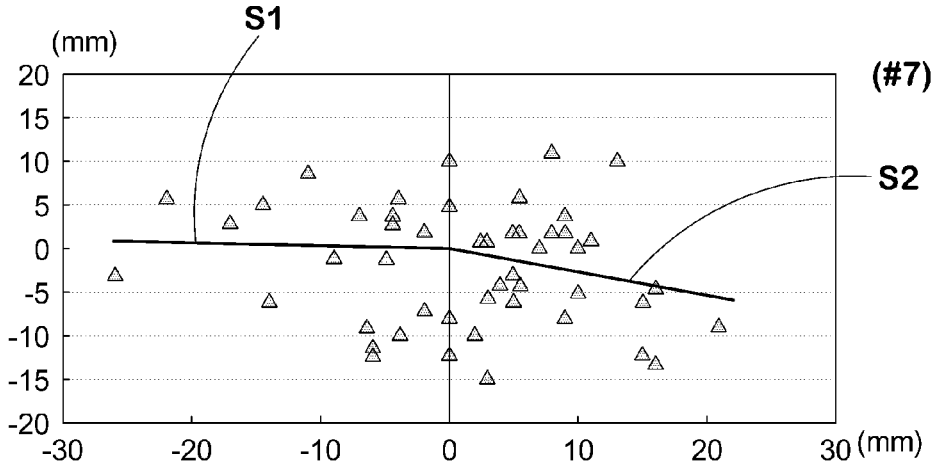

The inventor of the present invention experimented to check hit points on the clubface of each golf club in the set by actual hitting tests. The test results are shown in FIGS. 8*a* to 8*c*. FIGS. 8*a*, 8*b* and 8*c* each shows the result of a three wood (#3), a five wood (#5), and a seven wood (#7), respectively. Each golf club has the following specifications.

Three wood:
Loft angle: 15 degrees
Club length: 43.0 inches
Five wood:
Loft angle: 18 degrees
Club length: 42.0 inches
Seven wood:
Loft angle: 20 degrees
Club length: 41.5 inches As shown in FIGS. 8*a* to 8*c*, each graph has a coordinate system including the origin corresponding to the center SG of clubface, the lateral axis corresponding to the location of the clubface in the toe-heel direction, and the vertical axis corresponding to the location of the clubface in the up and down direction.

As shown in FIGS. 8*a* to 8*c*, approximate straight lines S1 and S2 of hit points on each clubface extending from the origin are drawn on each graph. It is understood that even if the clubs in the set have a series of common designs, each inclination of the approximate straight lines S1 and S2 is different. Especially, the longer the club (#3) is, the larger the angle of the approximate straight line with respect to the lateral axis is. Namely, the longer the club (#3) is, the larger the dispersal of hit points along with the up-and-down direction is.

On the other hand, the shorter the club (#7) is, the smaller the angle of the approximate straight lines S1 and S2 with respect to the lateral axis is. Namely, the shorter the club (#7) is, the larger the dispersal of hitting points along with the toe-heel direction is. The causes of these were guessed that if the club length becomes longer, there is a tendency that swing planes of golfers become closer to a horizontal, and if the club length becomes shorter, there is a tendency that swing planes of the golfers become closer to a vertical.

Figure 7B:
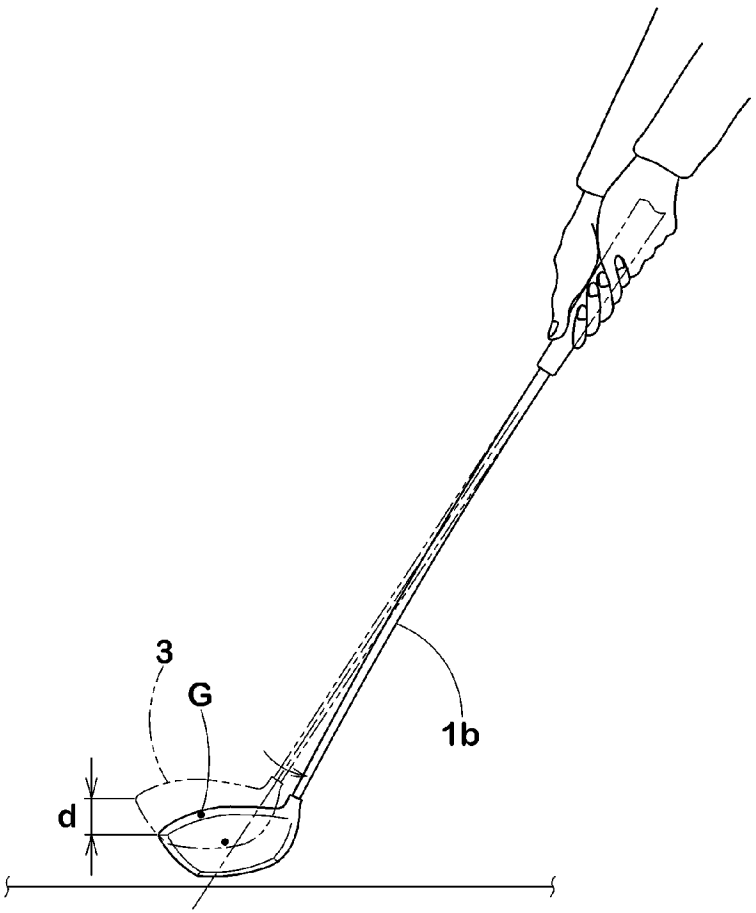
FIGS. 7*a* and 7*b* are schematic views each showing a toe-down phenomenon.
Figure 7A:
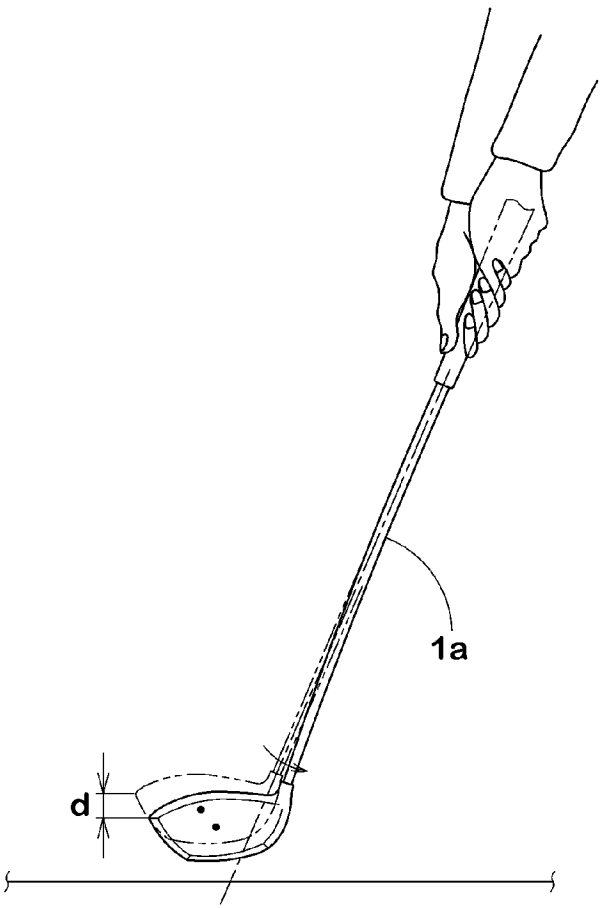

Also, toe-down phenomenon during a swing may be guessed as one of the causes of the trend of dispersal patterns of hit balls. During a swing of golf club 1, the club head 3 moves such that the center G of gravity of the head 3 approaches to the swing plane due to the centrifugal force while bending the clubshaft, as shown in FIGS. 7*a* and 7*b*. With this, the toe-side of the club head 3 goes downwardly in comparison with the time of the swing address shown as a chain line with tow dots. Moreover, due to the centrifugal force, the longer the club length is, the larger the toe-down displacement (d) in the phenomenon is, as shown in FIGS. 7*a* and 7*b*. The toe-down displacement (d) is the difference of the toe position of the club head 3 between the address state and the impact state during the swing. Therefore, in the golf clubs with long club length, dispersal pattern of hit points on the clubface tends to spread along the up-and-down direction of the clubface.

Since the dispersal patterns of hit points on the clubface 5 are approximately determined based on the club length L, the deterioration of the resilience performance of the face portion 6 at the time of miss shots can be suppressed by improving resilience performance on the area of the dispersal pattern of hit points on the face portion 6 according to each club length.

The present invention is accomplished in view of described above, thinner portions which improve the resilience performance of the club head 3 are disposed in a toe-side and a heel-side regions of the face portion 6 of each golf club 1, and the locations of thinner portions are varied according to the club length in the golf club set (A). With this, the present invention provides a golf club set to suppress the deterioration of the resilience performance of the face portion at the time of miss shots. The details of the thinner portions are as follows.

Figure 5:
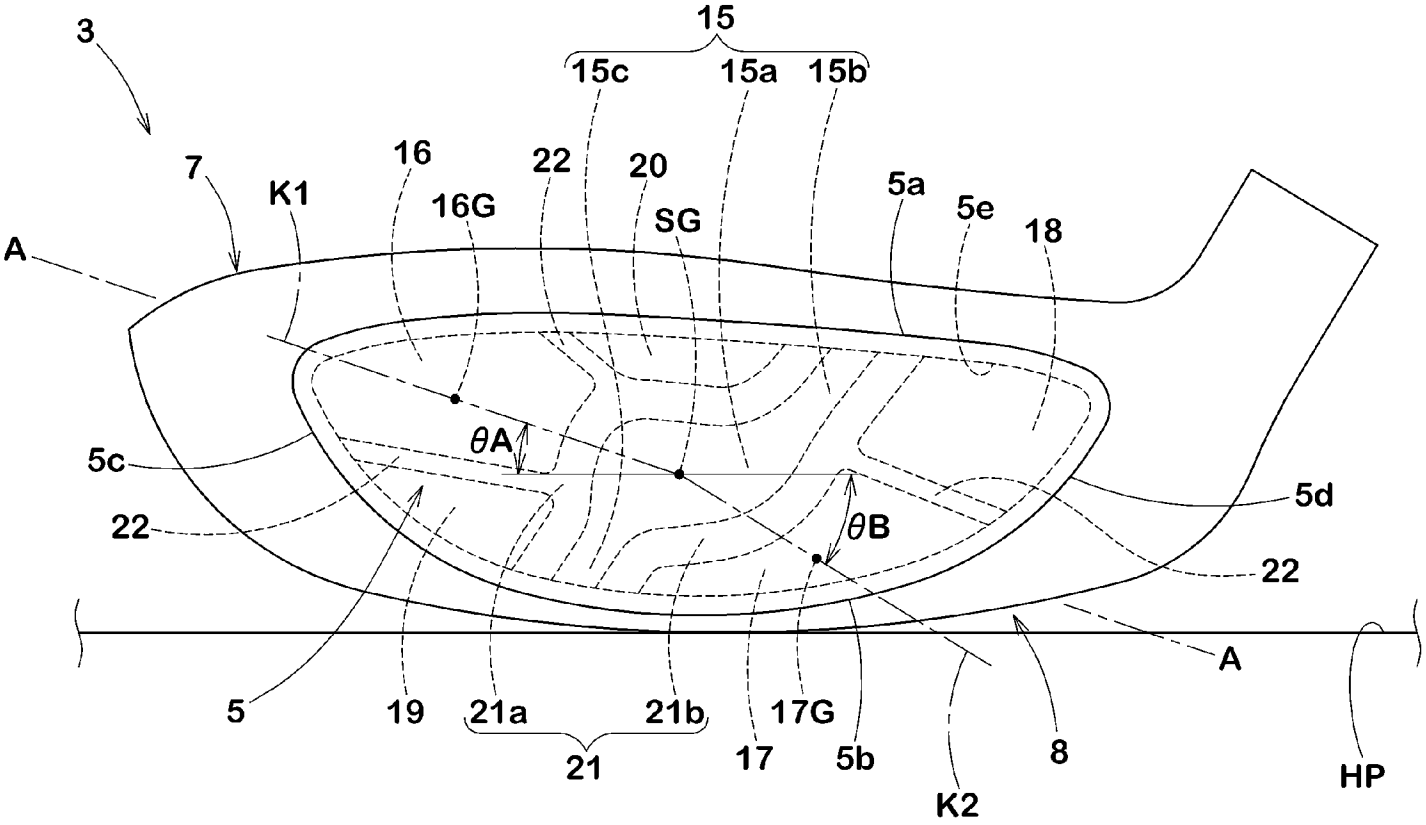
FIG. 5 is a perspective front view of the golf club head of FIG. 3 showing a thickness distribution of the face portion.
Figure 6:
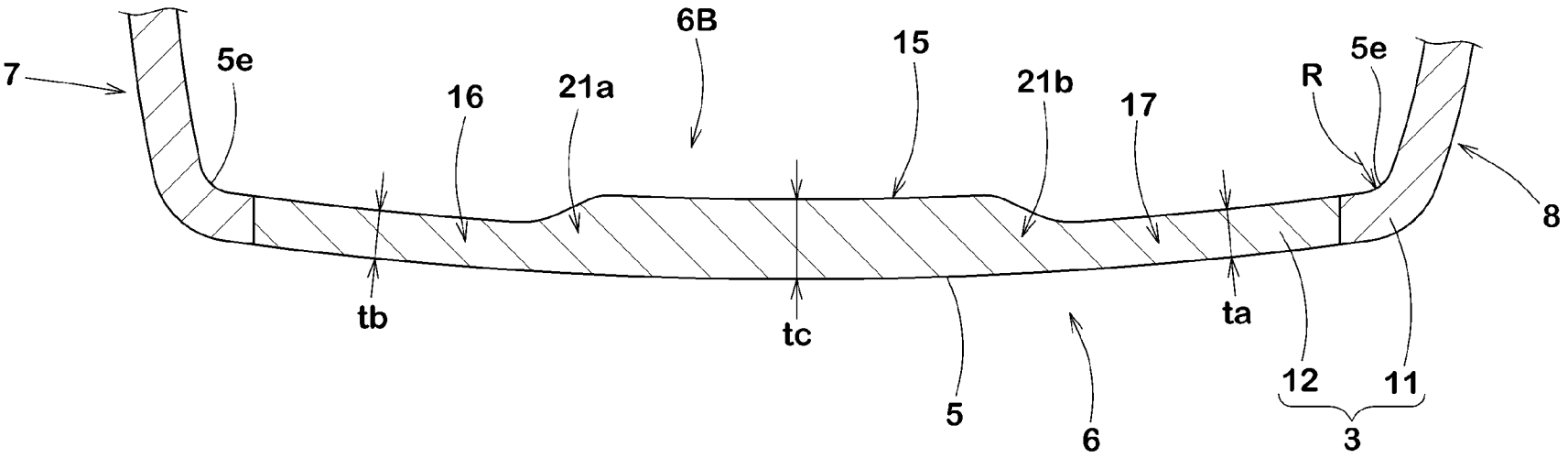
FIG. 6 is a cross sectional view taken along the line A-A of FIG. 5.

FIG. 5 shows a perspective front view of the golf club head 3, and FIG. 6 shows a cross sectional view taken along the line A-A of FIG. 5. As shown in FIGS. 5 to 6, the clubface 5 has a substantially smooth surface except for score lines (shown in FIG. 3) f and a punch mark (not shown). On the other hand, the inner surface 6B of the face portion 6 has a non-smooth surface so that the face portion 6 has difference thickness therein.

In this embodiment, the face portion 6 comprises a central thicker portion 15 provided in a center region of the face portion 6, a toe-side thinner portion 16 provided in a toe side region of the face portion 6 with a thickness tb smaller than that of the central thicker portion 15, and a heel-side thinner portion 17 provided in a heel side region of the face portion 6 with a thickness to smaller than that of the central thicker portion 15.

The central thicker portion 15 has the maximum thickness in the face portion 6. The center region of the face portion 6 is given a big impact force when hitting a ball. Therefore, by providing the central thicker portion 15 with the center region of the face portion 6, the durability of the face portion 6 can be improved. Here, the center region of the face portion 6 is a certain region at least including the center SG of the clubface 5. Also, the center region does not reach the contour edge 5*e* of the inner surface 6B of the face portion 6. The center SG of the clubface 5 means the center point of a horizontal line on the clubface which passes the middle height between the highest position of the clubface 5 and the lowest position of the clubface 5.

As shown in FIG. 6, the contour edge 5*e* of the inner surface 6B of the face portion 6 means a boundary between the inner surface 6B of the face portion 6 and inner surfaces of each of the crown portion 7, sole portion 8 and the side portion 9. When the boundary is unclear by being connected between the two inner surfaces using a chamfer portion in order to reduce a stress concentration, the contour edge 5*e* shall be defined as the center point of the length of an arc R of the chamfer in each cross section of the club head 1 as shown in FIG. 6.

As shown in FIG. 5, the central thicker portion 15 further comprises a main portion 15*a* being provided in the center region of the face portion 6 which has an oval shape along with the upper edge 5*a*, the lower edge 5*b* and the heel-side edge 5*d* of the clubface 5, an upper rib 15*b* extending upwardly from the heel-side of the main portion 15*a* to the upper edge 5*e* of the inner surface 6B of the face portion 6, and an lower rib 15*c* extending downwardly from the toe-side of the main portion 15*a* to the lower edge of the inner surface 6B of the face portion 6. The main portion 15*a* of the central thicker portion 15 makes the durability of the center region of the face portion 6 improves. Also, since a certain weight is disposed along with the centerline CL of the clubshaft by providing the upper and the lower ribs 15*b* and 15*c*, the moment of inertia around the centerline CL of the clubshaft becomes larger, and the direction of hit balls improves.

In order to maintain the durability of the face portion 6, the thickness tc of the central thicker portion 15 is preferably set not less than 2.0 mm, and more preferably not less than 2.2 mm. On the other hand, if the thickness tc of the central thicker portion 15 is too large, the resilience performance of the face portion 6 tends to deteriorate and the head weight increased may make the swing balance of the club difficult. In view of above, the thickness tc of the central thicker portion 15 is preferably set not more than 3.0 mm, and more preferably not more than 2.8 mm. Further, the central thicker portion 15 is preferably formed as a substantially constant thickness. When impact area markings such as score lines are provided on the clubface 5, each part of the thickness of the face portion 6 shall be measured in a state that whole impact area markings are being filled.

In such a view described above, the area MC of the central thicker portion 15 is preferably set at least 10%, more preferably at least 12%, of the whole area MG of the inner surface 6B of the face portion 6. Also, the area MC of the central thicker portion 15 is preferably set at most 25%, more preferably at most 20%, of the whole area MG of the inner surface 6B of the face portion 6. Here, each area MC and MG shall be defined as a two-dimensional area that is projected onto the vertical plane VP as shown in FIG. 2. Although it is not particularly limited, the whole area MG of the inner surface 6B of the face portion 6 is preferably set in a range of from 15 to 25 $cm^2$.

The toe-side thinner portion 16 and the heel-side thinner portion 17 each has a substantially constant and the minimum thickness of the face portion 6. These thinner portions 16 and 17 provide flexibility for the face portion 6 to improve the resilience performance at the time of miss shots where a ball is hit at the toe-side or the heel side of the clubface 5. With this, the flight distance loss of hit ball at the time of miss shots can be reduced by employing these thinner portions 16 and 17.

Moreover, the face portion 6 comprises a toe-side middle portion 19 being provided between the toe-side thinner 16 portion 16 and the lower rib 15*c*, a heel-side middle portion 18 being provided between the heel-side thinner portion 17 and the upper rib 15*b*, and a crown-side middle portion 20 being provided between the upper rib 15*b* and the toe-side middle portion 19. Each middle portion 18 to 20 has the thickness smaller than that of the central thicker portion 15 and thicker than that of each thinner portion 16 and 17. By employing these middle portions 18 to 20, the rigidity between the central thicker portion 15 and thinner portion 16, 17 tends to gradually change, thereby the durability of the face portion 6 may be further improved.

Each golf club 1 in the set (A) is provided the toe-side and the heel-side thinner portions 16 and 17 based on the dispersal pattern of hit points on the clubface 5 of golfers which is approximately determined according to the club length, in order to suppress the deterioration of the resilience performance of the club head 3 at the time of miss shots.

Namely, in a front view of the club head 3 under the standard state as shown in FIG. 5, the toe-side thinner portion 16 is provided so that the centroid 16G thereof is placed upward than the center SG of the clubface 5 in each club 1 in the set (A). Similarly, the heel-side thinner portion 17 is provided so that the centroid 17G thereof is placed downward than the center SG of the clubface 5.

Next, in the set (A), as for the angle θA of the first straight line K1 which passes through the center SG of the clubface 5 and the centroid 16G of the toe-side thinner portion 16 with respect to the horizontal plane HP, and the angle θB of the second straight line K2 which passes through the center SG of the clubface 5 and the centroid 17G of the heel-side thinner portion 17 with respect to the horizontal plane HP, the longer the club length L is, the larger the angles of θA and θB are.

Such golf clubs in the set (A) each have the suitable arrangement of thinner portions 16 and 17 according to the dispersal pattern of hit balls on the clubface 5, and therefore, the deterioration of the flight distance losses at the time of miss shots can be reduced to the minimum, for example. Here, the front view of the club head 3 means to view the club head 3 from the front side and the perpendicular direction F (as shown in FIG. 2) with respect to the vertical plane VP. The centroid 16G and 17G, and the center SG of the clubface 5 are determined based on the area MA of the toe-side thinner portion 16, the area MB of the heel-side thinner portion 17 and the area MG of the inner surface 6B of the face portion 6, respectively.

As shown in FIGS. 8*a* to 8*c*, for example, when the club length L becomes longer, the approximate straight lines S1 and S2 of hit points on the clubface 5 extending from the origin tend to have inclinations larger with respect to the horizontal axis. On the other hand, each angles θA and θB approximately represents each location of the toe-side thinner portion 16 and the heel-side thinner portion 17 which have high resilience performance, respectively. Therefore, by increasing angles θA and θB of thinner portions 16 and 17 so as to have a correlation with the angles of approximate straight lines S1 and S2, the flight distance losses of hit ball at the time of miss shots can be reduced to the minimum, for example.

In order to further improve the effect of the invention, it may be preferable that, in each golf club, the angle θA (degrees) of the first straight line K1 and the club length L (inches) are satisfied the following relation:

$$3.1\times L-120<\theta A<3.1\times L-114.$$

Similarly, In order to further improve the effect of the invention, it may be preferable that, in each golf club, the angle θB (degrees) of the second straight line K2 and the club length L (inches) are satisfied the following relation:

$$6.7\times L-259<\theta B<6.7\times L-253.$$

Here, each equation described above has a relation of a linear function between the angle θA or θB and the club length L.

In order to further improve the effect of the invention, it is preferable that angles θA and θB may be approximated to angles of the approximately straight lines S1 and S2 on the dispersal patterns of hit balls, as shown in FIGS. 8*a* to 8*c*. Thereby, it may be preferable that the angle θA of the first straight line K1 is set in a range of from 10 to 20 degrees, and the angle θB of the second straight line K2 is set in a range of from 20 to 35 degrees. Further, it may be preferable that the angle θA is set in a range of from 12 to 18 degrees, and the angle θB is set in a range of from 22 to 33 degrees. Moreover, the angle θB is preferably set greater than the angle θA to be fitted the result of hitting tests described above, as shown in FIGS. 8*a* to 8*c*.

The thickness ta of the toe-side thinner portion 16 and the thickness tb of the heel-side thinner portion 17 are preferably set at least 1.0 mm, more preferably at least 1.2 mm, and preferably at most 2.0 mm, more preferably 1.8 mm. If the thicknesses ta and tb are too small, there may be a tendency that the durability of the face portion 6 is deteriorated. On the other hand, if the thicknesses ta and tb are too large, the resilience performance tends to be decreased.

The area MA of the toe-side thinner portion 16 is preferably set at least 7% of the whole area MG of the inner surface 6*b* of the face portion 6, more preferably at least 10%, and preferably set at most 23% of the whole area MG of the inner surface 6*b* of the face portion 6, more preferably at most 20%. Similarly, the area MB of the heel-side thinner portion 17 is preferably set at least 5% of the whole area MG of the inner surface 6*b* of the face portion 6, more preferably at least 8%, and preferably set at most 18% of the whole area MG of the inner surface 6*b* of the face portion 6, more preferably at most 15%. If the area MA of the toe-side thinner portion 16 and the area MB of the heel-side thinner portion 17 are too small, improved resilience performance may not be obtained. If the area MA of the toe-side thinner portion 16 and the area MB of the heel-side thinner portion 17 are too large, there may be a tendency that durability of the face portion 6 is deteriorated.

Although it is not particularly limited, the total area MS of middle portions 18 to 20 is preferably set at least 15% of the whole area MG of the inner surface 6*b* of the face portion 6, and preferably at least 17%, and is preferably set at most 26% of the whole area MG of the inner surface 6*b* of the face portion 6, and preferably 24%, in order to maintain both the durability of the face portion 6 and weight reduction of the club head in a proper balance.

Similarly, each middle portion 18, 19 and 20 preferably has the thickness of at least 55% of the thickness tc of the central thicker portion 15, more preferably at least 60%, and preferably at most 80% of the thickness tc of the central thicker portion 15, more preferably at most 75%.

The first transit portion 21 may be provided on both sides of the central thicker portion 15 which has a thickness being gradually decreasing toward the edge 5*e* of the inner surface 6B of the face portion 6. The first transit portion 21 comprises a toe-side transit portion 21*a* provided on the toe-side of the face portion 6 and a heel-side transit portion 21*b* provided on the heel-side of the face portion 6. Each transit portion 21*a* and 21*b* connects between the crown portion 7 and the sole portion 8 at the interior of the club head 3.

At least one second transit portion 22 may be provided between one thinner portion 16 or 17 and one middle portion 18, 19 or 20 which extends from the first transit portion 21 to the edge 5*e* of the inner surface 6B of the face portion 6. The second transit portion 22 has a thickness being gradually decreasing toward the thinner portion 16 or 17.

By employing these transit portions 21 to 22, the rigidity of the face portion tends to gradually change, thereby the durability of the face portion 6 may be further improved. Although the transit portions 21 and 22 are formed as a constant width in this embodiment, it is not limited to only such embodiments.

While preferable embodiments of the present invention have been described with reference to the drawings, it goes without saying that the present invention is not limited to only such embodiments and various changes and modifications may be made.

The present invention is more specifically described and explained by means of the following Examples and References. It is to be understood that the present invention is not limited to these Examples.

Comparison Test:

In order to confirm the effect of the present invention, wood-type golf club sets each including five wood-type golf clubs of #3, #4, #5, #7 and #9 were manufactured according to the specifications shown in Table 1, and tests of resilience performance thereof were made. Each golf club had a common FRP clubshaft (MP600 FLEX R manufactured by SRI Sports Limited.), and a golf club head of a two-piece structure which has a main body produced by precision Lost-wax casting of Ti-6Al-4V, and a pressed face plate of Ti-6Al-4V attached to the main body by laser welding. Moreover, the angles θA and θB are adjusted without changing the head weight in each club number.

Specifications of golf clubs were common to all clubs except for parameters listed on Table.1. Major specifications of golf clubs were as follows.

Three-Wood (#3)
- Lie angle α: 58 degrees
- Loft angle: 15 degrees
- Head volume: 177 $cm^3$
- Head weight: 206 g
- Club length L: 43.0 inches Four-Wood (#4)
- Lie angle α: 58.5 degrees
- Loft angle: 16.5 degrees
- Head volume: 165 $cm^3$
- Head weight: 211 g
- Club length L: 42.5 inches Five-Wood (#5)
- Lie angle α: 59 degrees
- Loft angle: 18 degrees
- Head volume: 151 $cm^3$
- Head weight: 215 g
- Club length L: 42.0 inches Seven-Wood (#7)
- Lie angle α: 59.5 degrees
- Loft angle: 20 degrees
- Head volume: 139 $cm^3$
- Head weight: 220 g
- Club length L: 41.5 inches Nine-Wood (#9)
- Lie angle α: 60 degrees
- Loft angle: 23 degrees
- Head volume: 130 $cm^3$
- Head weight: 224 g
- Club length L: 41.0 inches Common Specifications
- Thickness tc of central thicker portion: 2.6 mm
- Area Ratio MC/MG: 10 to 25%
- Thickness to of toe-side thinner portion: 1.6 mm
- Area Ratio MA/MG: 7 to 23%
- Thickness tb of heel-side thinner portion: 1.6 mm
- Area ratio MB/MG: 5 to 18%
- Thickness of heel-side middle portion: 1.7 mm
- Thickness of toe-side middle portion: 1.7 mm
- Thickness of crown-side middle portion: 1.8 mm
- Thickness of transit portions: gradually change The tests were made in the following manner.

Resilience Performance Test:

Each of ten right-handed average golfers with a swing speed ranging from 34 to 40 m/s hit thirty balls ("XXIO SUPER XD" manufactured by SRI Sports Limited.) by using golf clubs in each set, and the swing speed (HS) just before the impact, and a initial velocity of hit ball (BH) were measured, and then ratios BS/HS in each golf club were calculated. Results of test are shown in Table 1 as average values of ratios of ten golfers, and the larger the value, the higher the resilience performance.

TABLE 1

| | Ex. 1 | | | | | Ref. 1 | | | | | Ref. 2 | | | | |
|---|---|---|---|---|---|---|---|---|---|---|---|---|---|---|---|
| Club Number | #3 | #4 | #5 | #7 | #9 | #3 | #4 | #5 | #7 | #9 | #3 | #4 | #5 | #7 | #9 |
| Angle θA (deg.) | 16.8 | 15.2 | 13.4 | 12.2 | 10.5 | 10.3 | 10.3 | 10.3 | 10.3 | 10.3 | 10.5 | 12.2 | 13.4 | 15.2 | 16.8 |
| Angle θB (deg.) | 34 | 30.9 | 28.2 | 23.6 | 20.7 | 23.6 | 23.6 | 23.6 | 23.6 | 23.6 | 20.7 | 23.6 | 28.2 | 30.9 | 34 |
| Resilience Performance | | | 1.44 | | | | | 1.36 | | | | | 1.35 | | |

| | Ref. 3 | | | | | Ref. 4 | | | | | Ref. 5 | | | | |
|---|---|---|---|---|---|---|---|---|---|---|---|---|---|---|---|
| Club Number | #3 | #4 | #5 | #7 | #9 | #3 | #4 | #5 | #7 | #9 | #3 | #4 | #5 | #7 | #9 |
| Angle θA (deg.) | 16.8 | 15.2 | 13.4 | 12.2 | 10.5 | 10.3 | 10.3 | 10.3 | 10.3 | 10.3 | 10.5 | 12.2 | 13.4 | 15.2 | 16.8 |
| Angle θB (deg.) | 23.6 | 23.6 | 23.6 | 23.6 | 23.6 | 34 | 30.9 | 28.2 | 23.6 | 20.7 | 34 | 30.9 | 28.2 | 23.6 | 20.7 |
| Resilience Performance | | | 1.37 | | | | | 1.37 | | | | | 1.36 | | |

| | Ref. 6 | | | | | Ex. 2 | | | | | Ex. 3 | | | | |
|---|---|---|---|---|---|---|---|---|---|---|---|---|---|---|---|
| Club Number | #3 | #4 | #5 | #7 | #9 | #3 | #4 | #5 | #7 | #9 | #3 | #4 | #5 | #7 | #9 |
| Angle θA (deg.) | 0 | 0 | 0 | 0 | 0 | 13 | 11.5 | 10 | 8.5 | 7 | 19.5 | 18 | 16.5 | 15 | 13.5 |
| Angle θB (deg.) | 0 | 0 | 0 | 0 | 0 | 34 | 30.9 | 28.2 | 23.6 | 20.7 | 34 | 30.9 | 28.2 | 23.6 | 20.7 |
| Resilience Performance | | | 1.34 | | | | | 1.40 | | | | | 1.41 | | |

| | Ex. 4 | | | | | Ex. 5 | | | | | Ex. 6 | | | | |
|---|---|---|---|---|---|---|---|---|---|---|---|---|---|---|---|
| Club Number | #3 | #4 | #5 | #7 | #9 | #3 | #4 | #5 | #7 | #9 | #3 | #4 | #5 | #7 | #9 |
| Angle θA (deg.) | 16.5 | 15 | 13.5 | 12 | 10.5 | 19 | 17.5 | 16 | 14.5 | 13 | 17.8 | 16.3 | 14.7 | 13.2 | 11.6 |
| Angle θB (deg.) | 34 | 30.9 | 28.2 | 23.6 | 20.7 | 34 | 30.9 | 28.2 | 23.6 | 20.7 | 29 | 25.5 | 22 | 19 | 15.5 |
| Resilience | | | 1.42 | | | | | 1.43 | | | | | 1.40 | | |

TABLE 1-continued

| Performance | | | | | | | | | | |
|---|---|---|---|---|---|---|---|---|---|---|
| | Ex. 7 | | | | | Ex. 8 | | | | |
| Club Number | #3 | #4 | #5 | #7 | #9 | #3 | #4 | #5 | #7 | #9 |
| Angle θA (deg.) | 17.8 | 16.3 | 14.7 | 13.2 | 11.6 | 17.8 | 16.3 | 14.7 | 13.2 | 11.6 |
| Angle θB (deg.) | 29.5 | 26 | 22.5 | 19.5 | 16 | 35.5 | 32 | 28.5 | 25.5 | 22 |
| Resilience Performance | | | 1.42 | | | | | 1.41 | | |

| | Ex. 9 | | | | | Ex. 10 | | | | |
|---|---|---|---|---|---|---|---|---|---|---|
| Club Number | #3 | #4 | #5 | #7 | #9 | #3 | #4 | #5 | #7 | #9 |
| Angle θA (deg.) | 17.8 | 16.3 | 14.7 | 13.2 | 11.6 | 17.8 | 16.3 | 14.7 | 13.2 | 11.6 |
| Angle θB (deg.) | 35 | 31.5 | 28 | 25 | 21.5 | 15.5 | 14.3 | 13.2 | 12.1 | 10.5 |
| Resilience Performance | | | 1.43 | | | | | 1.39 | | |

From the results shown in Table 1, it was confirmed that the golf club sets of the Examples according to the present invention can be improved resilience performance in comparison with References. Moreover, the same tests described above were made by changing club length, the same results as Table.1 were confirmed.

The invention claimed is:

1. A golf club set comprising a plurality of golf clubs each with different club length, each golf club comprising a clubshaft and a hollow golf club head attached to an one end of the clubshaft, the golf club head having a face portion whose front face defines a clubface for hitting a ball, the face portion comprising (a) a central thicker portion provided in a center region thereof, (b) a toe-side thinner portion provided in a toe side of the face portion and having a thickness smaller than that of the central thicker portion, and (c) a heel-side thinner portion provided in a heel side of the face portion and having a thickness smaller than that of the central thicker portion, wherein boundaries of said toe-side thinner portion and said heel-side thinner portion are entirely defined by an outer contour edge of the face portion and portions of the face portion with a thicker wall thickness, wherein said central thicker portion (a) comprises a main portion provided in the center region of the face portion so as to include the center of gravity SG of the clubface and a lower rib extending downwardly from the toe-side of the main portion to a lower edge of an inner surface of the face portion, wherein said heel-side thinner portion (c) includes a part extending toward the lower rib through and below the center of gravity SG of the clubface when viewed from its front, and wherein, in a front view of the club head under a standard state that the golf club head is placed on a horizontal plane so that the center line of the clubshaft inclines at its lie angle within a vertical plane and the clubface inclines at its loft angle with respect to the vertical plane, the toe-side thinner portion (b) is provided so that a centroid thereof is placed upward than a center of the clubface, the heel-side thinner portion is provided so that a centroid thereof is placed downward than the center of the clubface, and as for an angle θA of a first straight line passing through the center of the clubface and the centroid of the toe-side thinner portion with respect to the horizontal plane, and an angle θB of a second straight line passing through the center of the clubface and the centroid of the heel-side thinner portion with respect to the horizontal plane, the longer the club length is, the larger the angles of θA and θB are.

2. The golf club set according to claim 1, wherein in each golf club, the angle θA (degrees) of the first straight line and the club length L (inches) satisfy the following relation: $3.1\times L-120<\theta A<3.1\times L-114$.

3. The golf club set according to claim 1, wherein in each golf club, the angle θB (degrees) of the second straight line and the club length L (inches) are satisfied the following relation: $6.7\times L-259<\theta B<6.7\times L-253$.

4. The golf club set according to claim 1, wherein in each golf club, the angle θA of the first straight line is from 10 to 20 degrees, and the angle θB of the second straight line is more than the angle θA and of from 20 to 35 degrees.

5. The golf club set according to claim 1, wherein the central thicker portion has a thickness of from 2.0 to 3.0 mm, and the toe-side thinner portion and the heel-side thinner portion each has the thickness of from 1.0 to 2.0 mm.

6. The golf club set according to claim 1, wherein each golf club has the club length of from 35 to 46 inches.

7. The golf club set according to claim 1, wherein the face portion comprises a first transitional portion which extends from the central thicker portion to the toe-side thinner portion, and a thickness of the first transitional portion is gradually decreased toward the toe-side thinner portion.

8. The golf club set according to claim 1, wherein the face portion comprises a second transitional portion which extends from the central thicker portion to the heel-side thinner portion, and a thickness of the second transitional portion is gradually decreased toward the heel-side thinner portion.

9. The golf club set according to claim 1, wherein the central thicker portion comprises an upper rib extending upwardly from the heel-side of the main portion to an upper edge of an inner surface of the face portion.

10. The golf club set according to claim 9, wherein a heel-side middle portion is provided between the heel-side thinner portion and the upper rib, and the heel-side middle portion has a thickness smaller than that of the central thicker portion and thicker than that of the heel-side thinner portion.

11. The golf club set according to claim 9, wherein a crown-side middle portion is provided between the toe-side thinner portion and the upper rib, and the crown-side middle portion has a thickness smaller than that of the central thicker portion and thicker than that of the toe-side thinner portion.

12. The golf club set according to claim 1, wherein a toe-side middle portion is provided between the toe-side thinner portion and the lower rib, and the toe-side middle portion has a thickness smaller than that of the central thicker portion and thicker than that of the toe-side thinner portion.

13. The golf club set according to claim 1, wherein the central thicker portion has the maximum thickness in the face portion, and the toe-side thinner portion and the heel-side thinner portion each has the minimum thickness in the face portion.

14. The golf club set according to claim 13, wherein the toe-side thinner portion has an area MA of from 7% to 23% with respect to the whole area MG of an inner surface of the face portion, and the heel-side thinner portion has an area MB of from 5% to 18% with respect to the whole area MG of the inner surface of the face portion.

15. The golf club set according to claim 1, wherein each of the toe-side thinner portion and the heel-side thinner portion has a thickness in a range of from 1.0 to 1.8 millimeters.

16. The golf club set according to claim 1, wherein each of the toe-side thinner portion and the heel-side thinner portion has a substantially constant thickness.

* * * * *